United States Patent [19]

Cobb, III et al.

[11] Patent Number: 4,543,454

[45] Date of Patent: Sep. 24, 1985

[54] SLIDE ACTION ELECTRICAL SWITCHES

[75] Inventors: Albert R. Cobb, III, Glenview; Charles E. Black, Mt. Prospect, both of Ill.

[73] Assignee: Indak Manufacturing Corp., Northbrook, Ill.

[21] Appl. No.: 560,757

[22] Filed: Dec. 12, 1983

[51] Int. Cl.[4] ..... H01H 15/04

[52] U.S. Cl. ..... 200/16 A; 200/16 C; 200/260

[58] Field of Search ..... 200/16 R, 16 A, 16 B, 200/16 C, 16 D, 16 E, 16 F, 61.27, 164 R, 164 A, 257, 260, 291

[56] References Cited

U.S. PATENT DOCUMENTS 3,267,226 8/1966 Shaw et al. ..... 200/260

3,721,779 3/1973 Raab ..... 200/16 C

*Primary Examiner*—A. D. Pellinen

*Assistant Examiner*—Morris Ginsburg

*Attorney, Agent, or Firm*—Burmeister, York, Palmatier, Hamby & Jones

[57] ABSTRACT

In each of the two disclosed switches, an electrically conductive contactor plate is mounted on an insulating carriage, slidable in a casing along a path which is parallel with first and second parallel contact bars, mounted on an insulating wall of the casing. The contactor plate has first and second contact points for slidably engaging the contact bars during a portion of the movement of the contactor plate. During the remainder of such movement, the contact points slidably engage insulating boss portions which project from the insulating wall and are flush with the contact bars. The contactor plate has a third contact point projecting therefrom and slidable along an insulating ridge projecting from the insulating wall and disposed between the contact bars. The insulating ridge is flush with the contact bars for slidably supporting the third contact point while keeping it from engaging the contact bars. The insulating ridge is also flush with and connects with the insulating boss portions. The three contact points provide a stable tripod support for the contactor plate to distribute the biasing force of a spring disposed between the contactor plate and the carriage.

9 Claims, 48 Drawing Figures

SLIDE ACTION ELECTRICAL SWITCHES

FIELD OF THE INVENTION

This invention relates to electrical switches which may have various applications, but are particularly applicable for use in automotive vehicles, such as automobiles and trucks.

BACKGROUND OF THE INVENTION

In certain aspects, the switches of the present invention may be regarded as improvements over the switch disclosed and claimed in the Raab U.S. Pat. No. 3,721,779, issued Mar. 20, 1973 and assigned to the assignee of the present application. In the switch of the Raab patent, a contactor in the form of a metal plate is slidable with an insulating carriage along a linear path within a casing. The contactor plate is formed with three contact points which are engageable with three fixed contact bars, mounted on an insulating wall of the casing. Two of the contact points are selectively engageable with two of the fixed contact bars which are connected together by a cross bar, formed in one piece with such bars. The third contact point on the contactor slidably engages a third fixed contact bar throughout the range of movement of the contactor. One terminal of the switch is connected to the cross bar portion extending between the first and second bars. The second terminal of the switch is connected to the third bar. The switch of the Raab patent provides a simple ON-OFF switching action, in which there is one OFF position, at one end of the range of movement of the contactor, when the first and second contact points are moved out of engagement with the first and second fixed contact bars. The switch is ON when the first and second contact points engage the first and second bars and remains ON throughout the remainder of the range of movement of the contactor.

SUMMARY OF THE INVENTION

One principal object of the present invention is to provide new and improved switches which are capable of providing one ON position and either one or two OFF positions, while requiring only two fixed contact bars, and while providing the tripod supporting stability afforded by three contact points on the contactor plate.

This and other objects of the present invention are accomplished by providing an electrical switch having a casing, a carriage movable in said casing along a predetermined path, an electrically conductive contactor mounted on and movable with the carriage along such path, an electrically insulating wall member on the casing and generally parallel with such path, resilient means biasing the contactor toward such wall member, and first and second fixed contact members mounted on such wall member, the contactor having first and second contact points projecting therefrom and selectively engageable with the fixed contact members, the contactor having a third contact point slidably engageable with the insulating wall member throughout the range of movement of the contactor, the insulating wall member having insulating portions for slidably supporting the third contact point, which, however, never engages the fixed contact members.

The insulating portions of the wall member may include a particular insulating portion disposed between the fixed contact members, the third contact point being movable along such particular insulating portion without ever engaging the contact members. The particular insulating portion may be in the form of an insulating ridge extending between the contact members. Such insulating ridge may be flush with the contact members.

The contact members may be in the form of contact bars, generally parallel with the path of movement of the contactor. The bars may be disposed on opposite sides of the insulating ridge.

The insulating ridge may be flush with the contact bars or members. The insulating wall may have insulating elements which are slidably engageable by the first and second contact points, when not engaging the contact members. Such insulating elements may be flush with the contact members, to provide for smooth sliding movement of the first and second contact points between the contact members and the insulating elements.

The three contact points afford a stable tripod support for the contactor, relative to the insulating wall and the contact members, so that the contactor has positional stability throughout its entire range of movement. The length and location of the first and second contact bars can be varied, to provide a wide variety of different switching functions.

BRIEF DESCRIPTION OF THE DRAWINGS

Further objects, advantages and features of the present invention will appear from the following description, taken with the accompanying drawings, in which.

Figure 15:
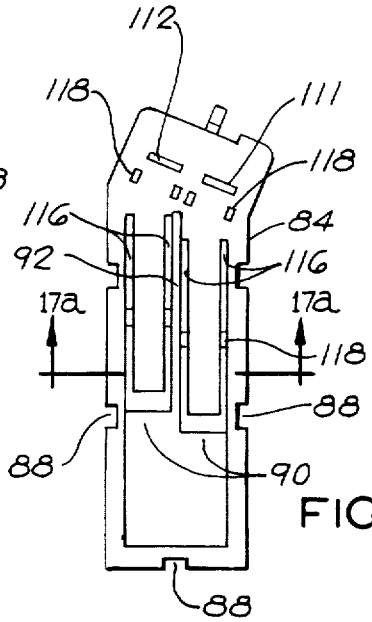
FIG. 15 is a bottom plan view of the insulating wall member.
Figure 17A:
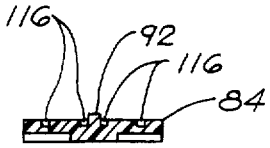
FIG. 17 is a fragmentary elevation, with a portion broken away, taken generally as indicated by the line 17—17 in FIG. 14.
Figure 16:
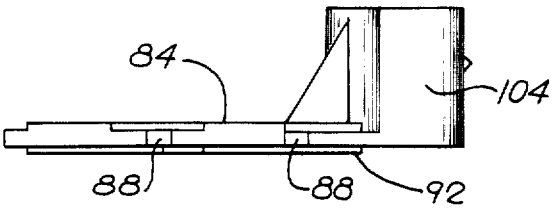
FIG. 16 is a side view, taken generally as indicated by the line 16—16 in FIG. 14.
Figure 17:
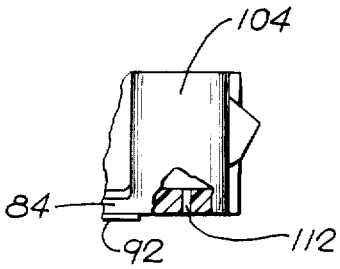

FIG. **17*a* is a sectional view, taken generally along the line 17*a*—17*a* in FIG. 15**.

Figure 1:
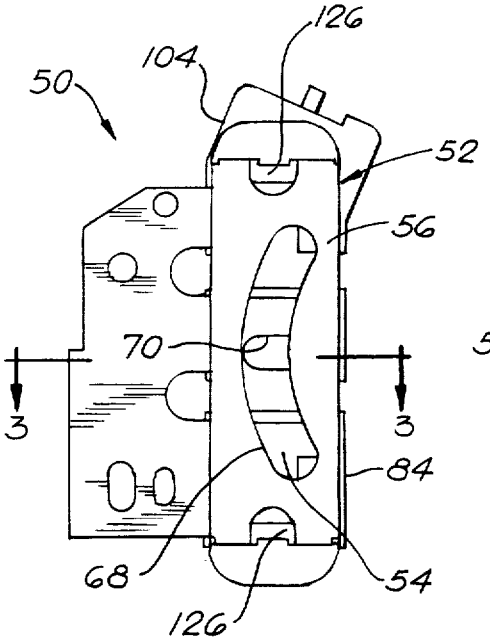
FIG. 1 is a bottom plan view of an electrical switch to be described as a first illustrative embodiment of the present invention.
Figure 2:
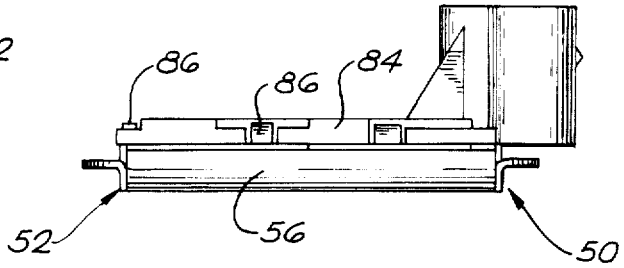
FIG. 2 is a side view of the switch, taken generally as indicated by the line 2—2 in FIG. 12.
Figure 3:
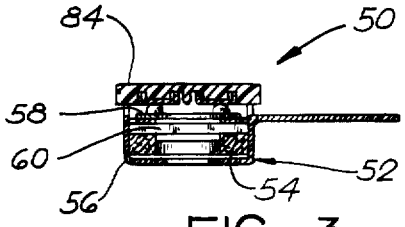
FIG. 3 is a sectional view, taken generally along the line 3—3 in FIG. 1.
Figure 18:
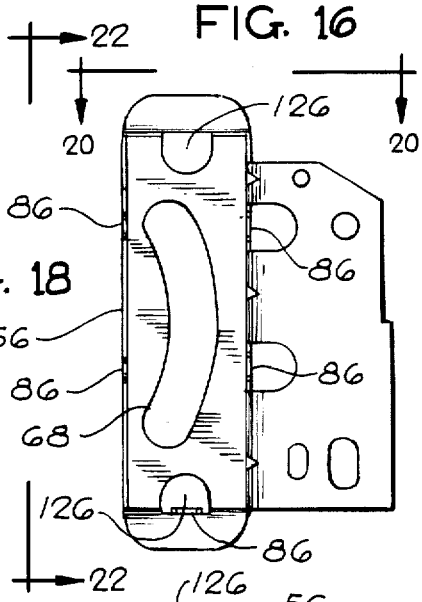

FIG. 18 is a top plan view of the metal component of the casing for the switch of FIG. 1.

Figure 19:
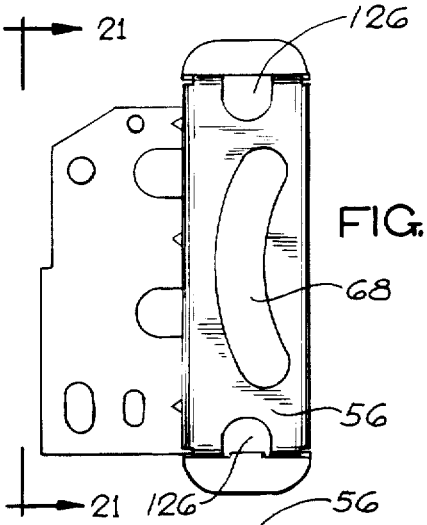

FIG. 19 is a bottom plan view of the metal component of the casing.

Figure 20:
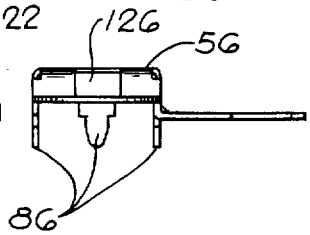

FIG. 20 is an end view, taken generally as indicated by the line 20—20 in FIG. 18.

Figure 21:
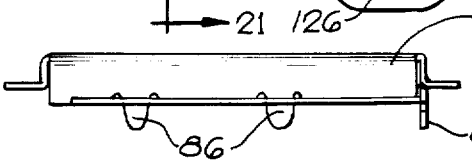

FIG. 21 is a side view, taken generally as indicated by the line 21—21 in FIG. 19.

Figure 22:
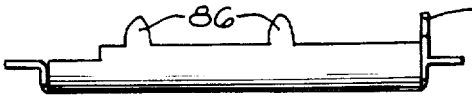

FIG. 22 is an opposite side view, taken generally as indicated by the line 22—22 in FIG. 18.

Figure 23:
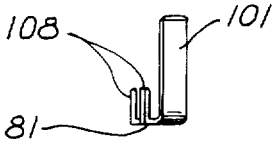

FIG. 23 is an end view of one of the fixed contact members for the switch of FIG. 1.

Figure 24:
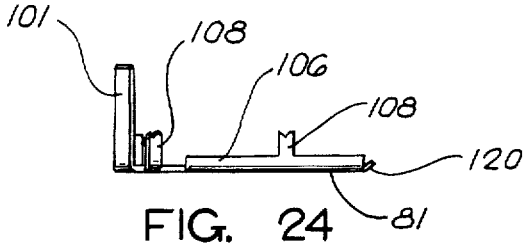

FIG. 24 is a side view of the fixed contact member of FIG. 23.

Figure 25:
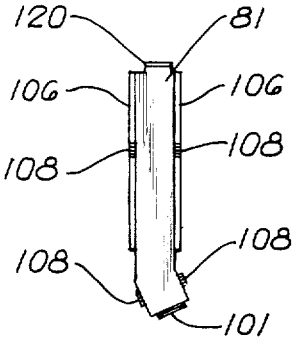

FIG. 25 is a plan view of the contact member of FIG. 23.

Figure 26:
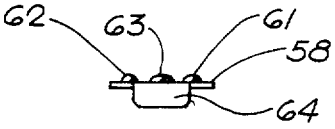

FIG. 26 is an end view of the contactor for the switch of FIG. 1.

Figure 27:
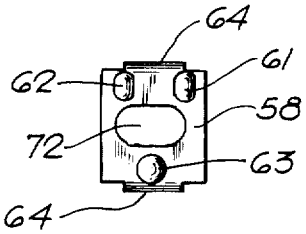

FIG. 27 is a plan view of the contactor.

Figure 28:
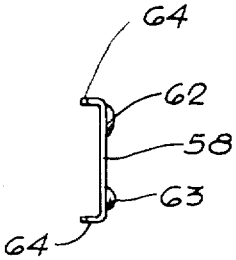

FIG. 28 is a side view of the contactor.

Figure 29:
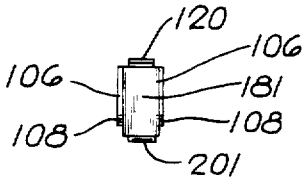

FIG. 29 is a plan view of a modified fixed contact member.

Figure 30:
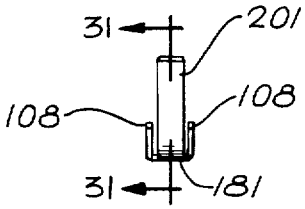

FIG. 30 is an end view of the fixed contact member of FIG. 29.

Figure 31:
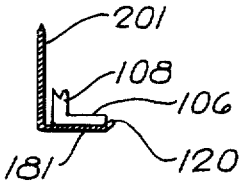

FIG. 31 is a section, taken generally along the line 31—31 in FIG. 30.

Figure 32:
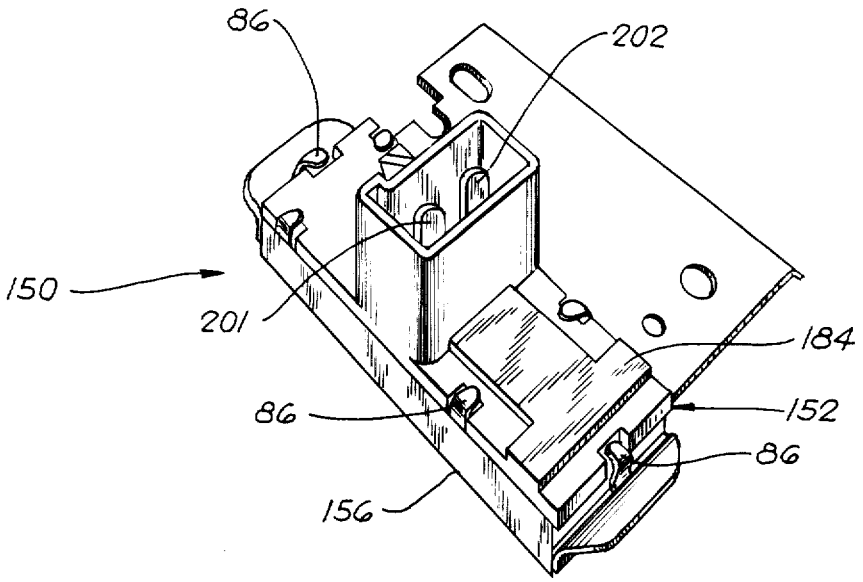

FIG. 32 is a perspective view of a modified electrical switch, to be described as a second illustrative embodiment of the present invention, such modified switch utilizing the modified fixed contact member of FIGS. 29-31.

Figure 33:
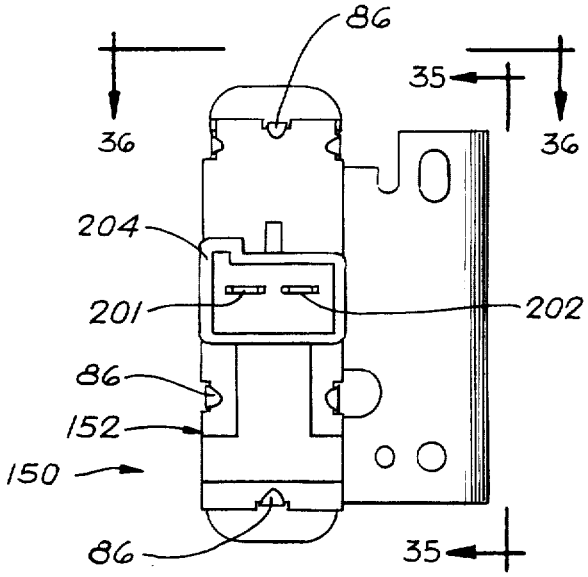
Figure 34:
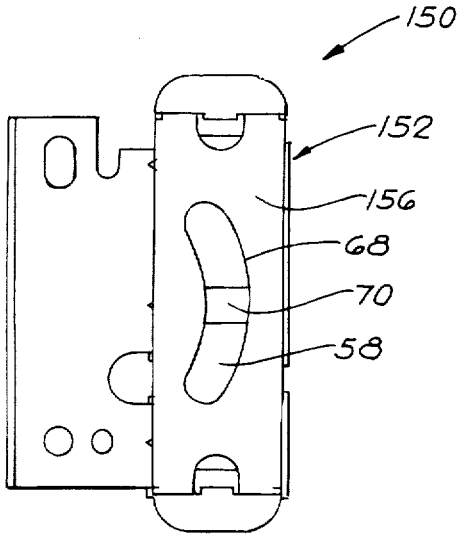

FIGS. 33 and 34 are top and bottom plan views of the switch of FIG. 32.

Figure 35:
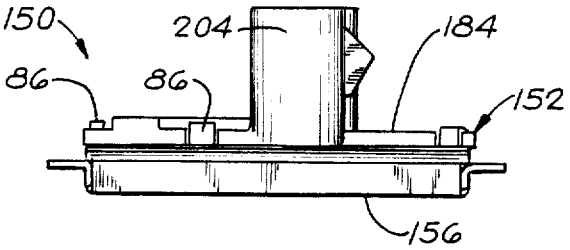
Figure 36:
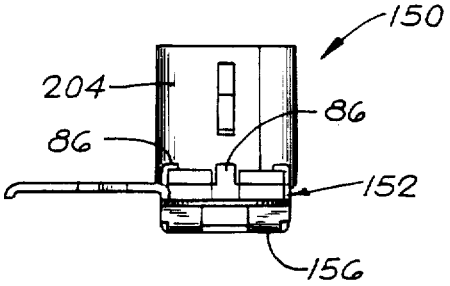

FIGS. 35 and 36 are side and end views of the switch of FIG. 32, taken generally as indicated by the lines 35—35 and 36—36 in FIG. 33.

Figure 37:
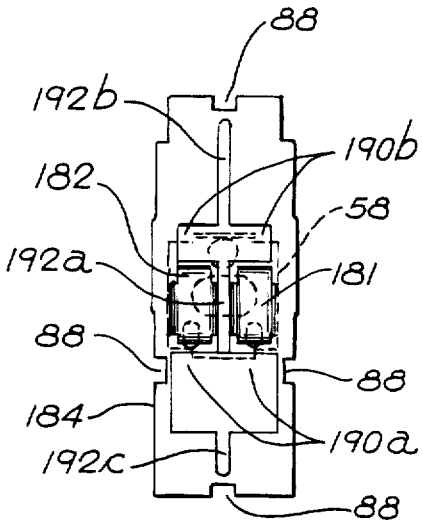

FIG. 37 is a bottom plan view of the insulating casing wall member and the fixed contact members for the switch of FIG. 32, the contactor being shown in broken lines.

Figure 38:
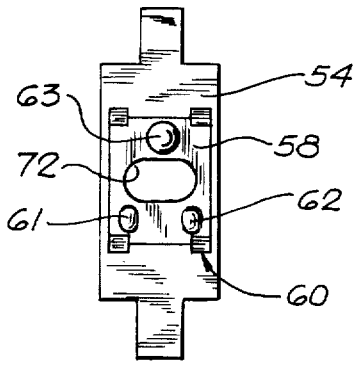

FIG. 38 is a plan view of the carriage and the contactor for the switch of FIG. 32.

Figure 39:
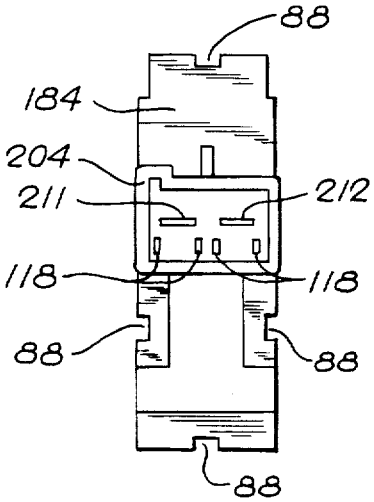
Figure 40:
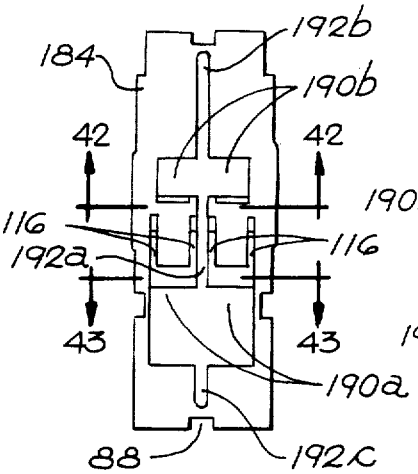

FIGS. 39 and 40 are top and bottom plan views of the insulating fixed contact supporting member for the switch of FIG. 32.

Figure 41:
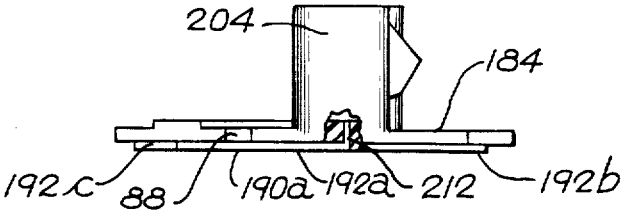

FIG. 41 is a side view of the contact supporting member of FIG. 39.

Figure 42:
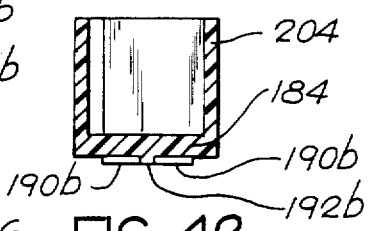
Figure 43:
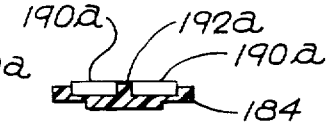

FIGS. 42 and 43 are sections, taken generally along the lines 42—42 and 43—43 in FIG. 40.

Figure 44:
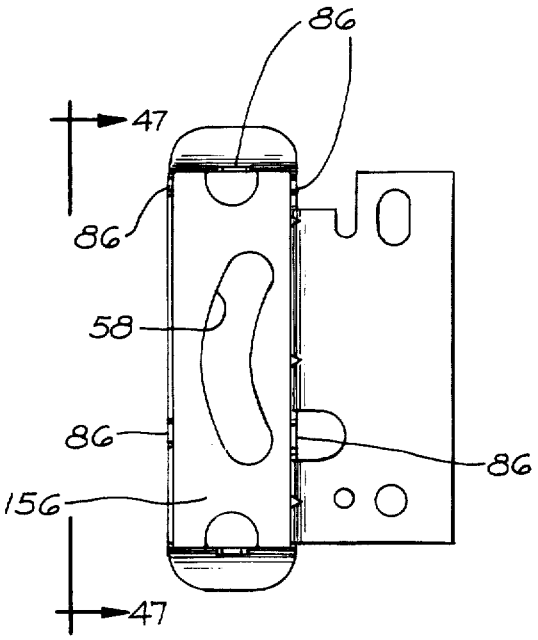
Figure 45:
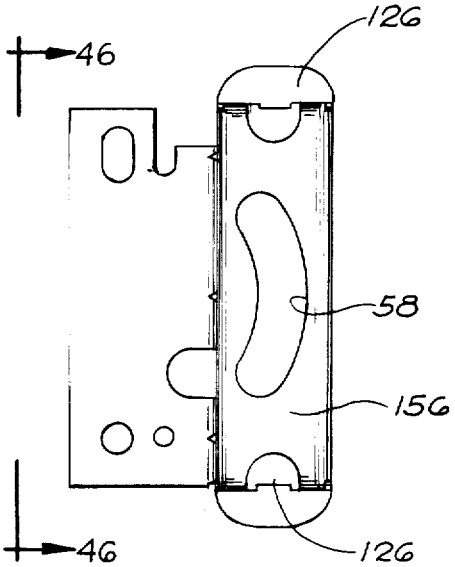

FIGS. 44 and 45 are top and bottom plan views of the metal component for the casing of the switch of FIG. 32.

Figure 46:
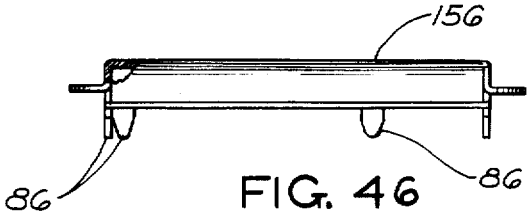
Figure 47:
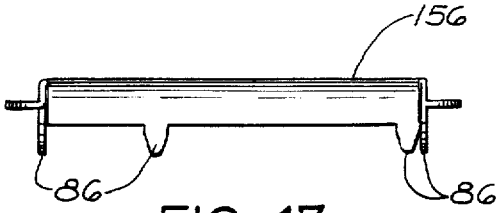

FIGS. 46 and 47 are opposite side views, taken generally along the line 46—46 in FIG. 45 and the line 47—47 in FIG. 44.

DETAILED DESCRIPTION OF ILLUSTRATIVE EMBODIMENTS

FIGS. 1-28 illustrate an electrical switch 50 to be described as a first illustrative embodiment of the present invention. The switch 50 will find many applications, but is particularly well adapted for automotive service. Thus, for example, the switch 50 may be employed to control the energization of an air conditioning clutch in a heating and air conditioning system for an automotive vehicle.

As shown in FIGS. 1-7, the switch 50 comprises a casing 52 having a carriage 54 movable therein along a predetermined path. In this case, the casing 52 has a box-shaped member 56 which guides the carriage 54 for sliding movement along a substantially linear path. The casing member or component 56 is made of metal in this instance, but may be made of any other suitable material. In this case, the carriage 54 is made of an electrically insulating material.

An electrically conductive contactor 58 is mounted on the carriage 54 for movement therewith along its path. The contactor 58 is resiliently biased relative to the carriage 54 by resilient means, shown as a spring 60, disposed between the carriage 54 and the contactor 58. The illustrated spring 60 is of the resilient leaf type, but any other suitable spring means may be employed.

The contactor 58 is illustrated as a conductive metal plate having three contact points 61, 62 and 63, formed thereon, and projecting therefrom away from the carriage 54. To locate the contactor 58 on the carriage 54, the contactor 58 is formed with tabs 64 which project into slots 66, forced in the carriage 54.

To provide for operation or movement of the carriage 54 along its longitudinal path, the box component 56 of the casing 52 is formed with a generally longitudinal slot 68, through which the carriage 54 is accessible. Thus, .for example, a pin on an external operating lever, not shown, may project through the slot 68 and into a slot 70 formed in the carriage 54. Corresponding clearance slots 72 and 74 are formed in the contactor 54 and the spring 60. The access slot 68 is shown as curved, in this case, to accommodate the arcuate movement of such an operating pin on an external operating lever.

The first and second contact points 61 and 62 on the contactor 58 are selectively engageable with first and second electrically conductive fixed contact members 81 and 82 mounted on a supporting member 84 which affords electrical insulation and is made of electrically insulating material in this instance. In this case, the electrically insulating member 84 forms one wall of the casing 52, while the other walls are formed by the box component 56. The insulating wall member 84 is suitably secured to the metal box component 56. As shown, the box component 56 has a plurality of tabs 86 which extend through notches 88 in the insulating component 84 and are bent or clinched inwardly, behind the insulating component 84.

Figure 4:
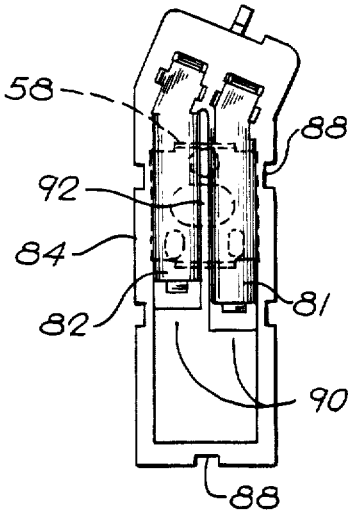
FIG. 4 is a bottom plan view showing the insulating wall of the casing for the switch, with the contact bars mounted thereon, and with the contactor shown in broken lines, the view being taken generally along the line 4—4 in FIG. 13.
Figure 5:
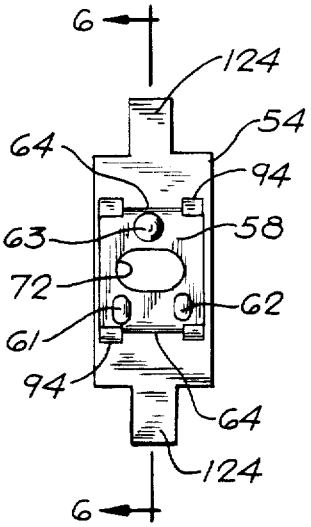
FIG. 5 is a top plan view of the carriage for the switch, with the contactor mounted thereon.
Figure 6:
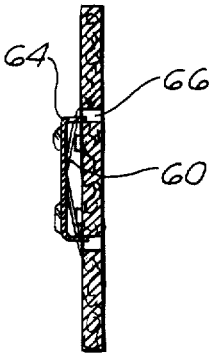
FIG. 6 is a sectional view through the carriage and contactor, taken generally along the line 6—6 in FIG. 5.
Figure 10:
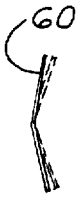
FIG. 10 is a side view of the contactor spring.
Figure 9:
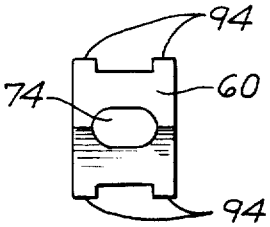
FIG. 9 is a plan view of the contactor spring for the switch.
Figure 7:
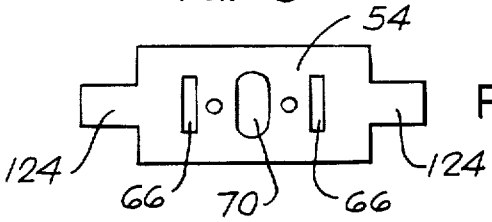
FIG. 7 is a plan view of the carriage for the switch.
Figure 8:
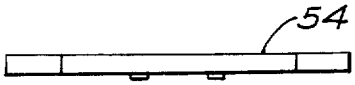
FIG. 8 is a side view of the carriage.

As shown in FIG. 4, the fixed contact members 81 and 82 are along the paths of the contact points 61 and 62. The illustrated contact members 81 and 82 are in the form of conductive contact bars which are parallel with the direction of movement of the contactor 58 and are spaced apart, edge to edge. During a portion of the range of movement of the contactor 58, the contact points 61 and 62 engage the fixed contact bars 81 and 82 and complete an electrical circuit between such bars, so that the switch is ON. During another portion of the range of movement of the contactor 58, one or both of the contact points 61 and 62 are out of engagement with the fixed contact bars 81 and 82, and rather engage the insulating member 84, so that the switch is OFF. The insulating member 84 has portions 90 which are flush with the contact bars 81 and are engageable by the contact points 61 and 62, so that the contact points are movable in a smooth manner between the bars 81 and 82 and the insulating portions 90.

The third contact point 63 is never engageable with the fixed contact bars 81 and 82, but rather is always in slidable engagement with portions of the insulating support member 84. In particular, the insulating member 84 has an insulating portion 92 which extends longitudinally between the fixed contact bars 81 and 82, for slidable engagement by the third contact point 63 to keep the third contact point out of engagement with the fixed contact bars 81 and 82. Preferably, the insulating portion 92 is in the form of an insulating ridge which projects from the insulating support member 84 and is preferably flush with the contact bars 81 and 82, which are on opposite sides of the insulating ridge 92. The third contact point 63 slides along the insulating ridge 92 which holds the contact point 63 out of engagement with the fixed contact bars 81 and 82. Preferably, the third contact point 63 is spherically rounded in shape so that the contact point 63 essentially has a single point contact with the insulating ridge 92.

The first and second contact points 61 and 62 are also preferably rounded in shape, and in this instance have an oblate spheroidal curvature, so that they slide smoothly between the insulating portions 90 and the fixed contact bars 81 and 82.

To locate and retain the spring 60 on the carriage 54, the spring 60 is preferably formed with pairs of tabs 94 which straddle the tabs 64 on the contactor 58.

Figure 11:
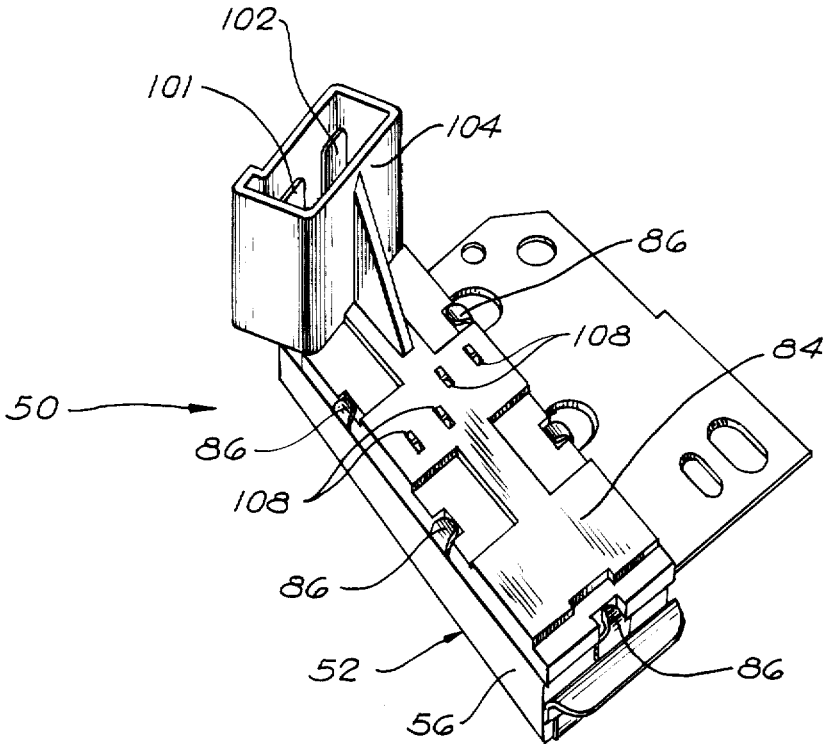
FIG. 11 is a perspective view of the electrical switch of FIG. 1.
Figure 12:
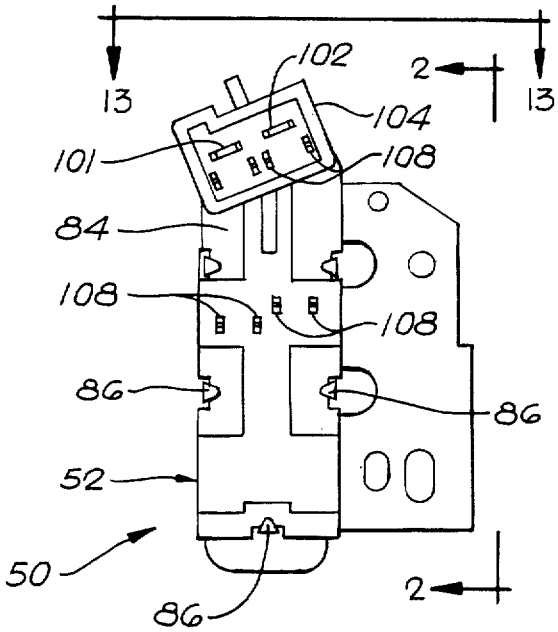
FIG. 12 is a top plan view of the switch.
Figure 13:
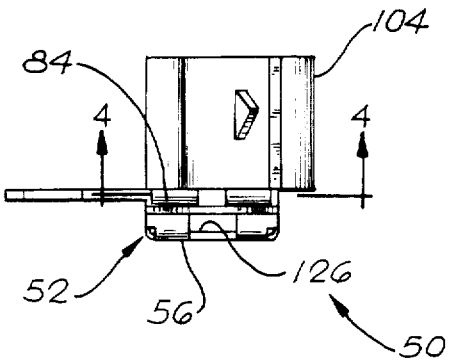
FIG. 13 is an end view, taken generally as indicated by the line 13—13 in FIG. 12.

As shown in FIGS. 11 and 12, the fixed contact bars 81 and 82 are formed with terminal prongs or lugs 101 and 102, adapted to receive an electrical connector which mates mechanically with a tubular housing 104, projecting from the insulating wall member 84. As shown in FIGS. 23–25, the terminal prongs 101 are bent at right angles from the contact bars 81 and 82. Longitudinal stiffening flanges 106 are preferably bent at right angles from the bars 81 and 82. Anchoring prongs 108 are also preferably formed on the contact bars 81 and 82.

Figure 14:
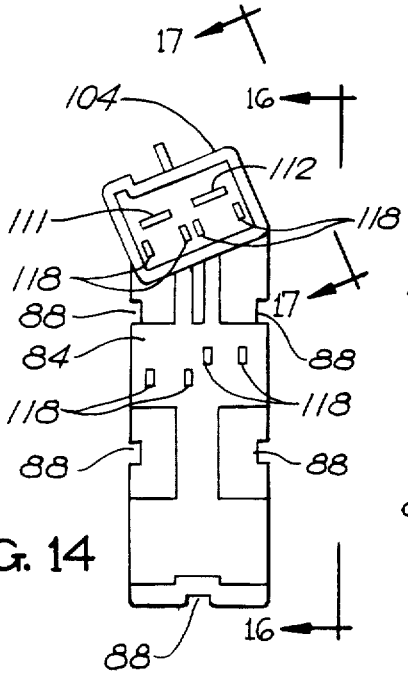
FIG. 14 is a top plan of the insulating wall member for the switch.

As shown in FIG. 14, the terminal prongs 101 and 102 extend through slots 111 and 112 in the insulating wall member 84. As shown in FIG. 15, the stiffening flanges 106 are received in channels or recesses 116, formed in the inwardly facing surface of the insulating member 84. The anchoring prongs 108 extend through slots 118 in the insulating wall member 84 and are suitably staked or clinched, as shown in FIGS. 11 and 12.

An inclined ramp 120 is bent from one end of each of the contact bars 81, at the end thereof opposite from the corresponding terminal prongs 101 and 102. The ramp 120 provides for smooth sliding movement of the contact points 61 and 62 between the contact bars 81 and 82 and the insulating portions 90 on the member 84.

The three contact points 61, 62 and 63 afford a stable tripod support for the contactor 58, throughout its range of movement with the carriage 54. This tripod support maintains the positional stability of the contactor 58 throughout its range of movement. While all three contact points 61, 62 and 63 are functional mechanically to provide such tripod support, only the first and second contact points 61 and 62 are functional electrically to afford selective engagement with the fixed contact bars 81 and 82. The third contact 63 is slidably engageable at all times with the insulating wall member 84 and specifically with the insulating ridge 92 thereon.

At both ends, the insulating carriage 54 is formed with longitudinally projecting tabs 124 which are movable through slots 126 in the ends of the casing 52, when the carriage 54 is moved to the opposite extremes of its range of longitudinal movement.

As shown in FIG. 4, the fixed contact bars 81 and 82 are relatively elongated and are located toward one end of the insulating contact support member 84. Thus, the fixed contact members 81 and 82 are engaged by the contact points 61 and 62 of the contactor 58, when the carriage is moved toward the corresponding end of its range of movement. The contactor 58 forms a bridging electrical connection between the fixed contact bars 81 and 82, so that the switch is in its ON position. When the carriage 54 is moved to the opposite end of its range of movement, the contact points 61 and 62 are disengaged from the fixed contact bars 81 and 82 so that the contact points engage the insulating portions 90 of the contact support member 84. Thus, the switch is in its OFF position. The transition between the ON and OFF positions depends upon the length and location of the fixed contact bars 81 and 82, in relation to the position of the first and second contact points 61 and 62. It will be evident from the drawings, particularly FIGS. 4, 11, 12 and 23, that the contact bars 81 and 82 are offset longitudinally to some extent, in their positions on the insulating wall member 84. This offsetting results from the fact that the contact bars 81 and 82 have a dog-leg shape, as viewed in FIG. 4, and are positioned on the insulating wall member 84 so that the temrinal prongs 101 and 102 are lined up, edge to edge, as shown in FIGS. 11 and 12, to receive a corresponding electrical connector.

The second embodiment of FIGS. 29–47 illustrates the fact that the length and location of the fixed contact bars can be varied, to provide a variety of different switching functions.

Thus, FIGS. 32–36 illustrate a slightly modified electrical switch 150 having a slightly modified casing 152 comprising a slightly modified metal box component 156, all very similar to the corresponding elements 50, 52 and 56 of the first embodiment. Generally, similar components of the second embodiment will be identified by the same reference characters, increased by 100. Many of the components of the second switch 150 are the same as the corresponding components of the first switch 50. In such cases, the same reference characters will be employed, so that the previous description will be fully applicable and need not be repeated.

Thus, as shown in FIG. 38, the second switch 150 employs the same carriage 54, contactor 58 and biasing spring 60, as employed in the first switch 50. All of the details of these components are exactly the same as previously described.

The second switch 150, employs slightly modified fixed contact members or bars 181 and 182 which are similar to those previously described but are shorter and located differently, as shown in FIG. 37. The contact bars 181 and 182 are mounted on a slightly modified insulating wall member 184 having insulating portions or bosses **190*a* and 190*b* located at opposite ends of the contact bars 181 and 182. The insulating portions 190*a* and 190*b* are preferably flush with the contact bars 181 and 182 to provide for smooth sliding movement of the contact points 61 and 62 between the contact bars and the insulating portions 190*a* and 190*b***.

As before, the third contact point 63 always engages the insulating support member 184, throughout the range of movement of the carriage 54 and the contactor 58. The insulating support member 184 has one or more insulating portions for slidable engagement by the third contact point 63. As shown in FIG. 37, such insulating portions, engageable by the third contact point 63, comprise a ridge **192*a* extending longitudinally between the fixed contact bars 181 and 182 and preferably flush with such bars. Additional similar ridge portions 192*b*** and 192*c* are provided at the opposite ends of the insulating bosses 190*a* and 190*b*. In certain positions of the switch 150, the third contact point 63 engages the insulating boss 190*b*, as shown in FIG. 37. In other positions, the contact point 63 engages the ridges 192*a* and 192*b*.

By providing the shortened and relocated fixed contact bars 181 and 182, the second switch 150. may have OFF positions at both ends of the range of movemeht of the carriage 54 and the contactor 58. In these opposite end positions, the contact points 61 and 62 engage the insulating bosses or portions 190*a* and 190*b*. For an intermediate portion of the range of movement of the contactor 58, the contact points 61 and 62 engage the fixed contact bars 181 and 182, so that the contactor 58 forms a bridging connection between the contact bars. Thus, the switch 150 is in its ON position.

Other detailed elements of the second switch 150 are represented by the same reference characters as in the case of the first switch 50, so that the previous description is fully applicable and need not be repeated.

As before, the three contact points 61, 62 and 63 provide a stable tripod support for the contactor 58 at all times, throughout the range of movement of the contactor 58, so that positional stability of the contactor is maintained at all times.

It will be evident that the switching function of the second switch 150 can be modified by changing the position of the contactor 58 on the carriage 54. Thus, the contactor 58 can be reversed, end for end, on the carriage 54 when the switch 150 is assembled.

Various other modifications, alternative constructions and equivalents may be employed without departing from the true spirit and scope of the present invention, as defined in the following claims.

We claim:

1. An electrical switch, comprising a casing, an electrically insulating carriage movable in said casing, means on said casing and said carriage for guiding said carriage for sliding movement along a substantially linear path, an electrically conductive contactor plate mounted on said carriage and movable therewith along said path, said casing having an insulating wall member generally parallel with said path, spring means between said carriage and said contactor plate for biasing said contactor plate toward said insulating wall member, and first and second electrically conductive elongated contact bars spaced apart from each other and separtely mounted on said insulating wall member while extending along and parallel with portions of said path, said contact bars being insulated from each other, said contactor plate having first and second contact points formed thereon and projecting therefrom for slidably engaging said first and second bars during movement of said contactor plate along said portions of said path, said insulating wall member having insulating boss portions projecting thereform and flush with said contact bars for slidable engagement by said first and second contact points during the remainder of said path, said contactor plate having a third contact point formed thereon and projecting therefrom towards said insulating wall member, said insulating wall member having an insulating ridge projecting therefrom and flush with said first and second contact bars while extending between said contact bars for slidable engagement by said third contact point, said third contact point being slidable along said insulating ridge between said contact bars without ever engaging said contact bars, said third contact point and said first and second contact points affording tripod support for said contactor plate relative to said insulating wall member and said contact bars to provide positional stability for said contactor plate throughout the range of movement thereof along said path.

2. An electrical switch according to claim 1, said contact bars having terminal prongs bent transversely therefrom, said insulating wall member having terminal prong slots for receiving said terminal prongs.

3. An electrical switch, comprising a casing, an electrically insulating carriage movable in said casing, means on said casing and said carriage for guiding said carriage for sliding movement along a substantially linear path, an electrically conductive contactor plate mounted on said carriage and movable therewith along said path, said casing having an insulating wall member generally parallel with said path, spring means between said carriage and said contactor plate for biasing said contactor plate toward said insulating wall member, and first and second electrically conductive elongated contact bars spaced apart from each other and separately mounted on said insulating wall member while extending along and parallel with portions of said path, said contact bars being insulated from each other, said contactor plate having first and second contact points formed thereon and projecting therefrom for slidably engaging said first and second contact bars during movement of said contact plate along said portions of said path, said insulating wall member having insulating boss portions projecting therefrom and flush with said contact bars slidable engagement by said first and second contact point during the remainder of said path, said contactor plate having a third contact point formed thereon and projecting therefrom towards said insulating wall member, said insulating wall member having an insulating ridge projecting therefrom and flush with said first and second contact bars while extending between said contact bars for slidable engagement by said third contact point.

said third contact point being slidable along said insulating ridge between said contact bars without ever engaging said contact bars, said third contact point and said first and second contact points affording tripod support for said contactor plate relative to said insulating wall member and said contact bars to provide positional stability for said contactor plate throughout the range of movement thereof along said path.

said insulating ridge being flush with said insulating boss portions, said insulating boss portions having constituent means connecting with said insulating ridge, said third contactor point being slidably engageable with said insulating ridge and said constituent means of said insulating boss portions during the entire path of movement of said contactor plate.

4. An electrical switch according to claim 3, said contact bars having longitudinal stiffening flanges thereon, said insulating wall member having recesses therein for receiving said stiffening flanges, certain of said recesses being adjacent said insulating ridge.

5. An electrical switch according to claim 4, said stiffening flanges having anchoring tabs extending therefrom, said insulating wall member having tab slots for receiving said anchoring tabs.

6. An electrical switch according to claim 5, said contact bars having terminal prongs bent transversely therefrom, said insulating wall member having terminal prong slots for rcceiving said terminal prongs.

7. An electrical switch, comprising a casing, an electrically insulating carriage movable in said casing, means on said casing and said carriage for guiding said carriage for sliding movement along a substantially linear path, an elcctrically conductive contactor plate mounted on said carriage and movable therewith along said path, said casing having an insulating wall member generally parallel with said path, spring means between said carriage and said contactor plate for biasing said contactor plate toward said insulating wall member, and first and second electrically conductive elongated contact bars spaced apart from each other and separately mounted on said insulating wall member while extending along and parallel with portions of said path, said contact bars being insulated from each other, said contactor plate having first and second contact points formed thereon and projecting therefrom for slidably engaging said first and second contact bars during movement of said contactor plate along said portions of said path, said insulating wall member having insulating boss portions projecting therefrom and flush with said contact bars for slidable engagement by said first and second contact points during the remainder of said path, said contactor plate having a third contact point formed thereon and projecting therefrom towards said insulating wall member, said insulating wall member having an insulating ridge projecting therefrom and flush with said first and second contact bars while extending between said contact bars for slidable engagement by said third contact point, said third contact point being slidable along said insulating ridge between said contact bars without ever engaging said contact bars, said third contact point and said first and second contact points affording tripod support for said contactor plate relative to said insulating wall member and said contact bars to provide positional stability for said contactor plate throughout the range of movement thereof along said path, said contact bars having longitudinal stiffening flanges thereon, said insulating wall member having recesses therein for receiving said stiffening flanges, certain of said recesses being adjacent said insulating ridge.

8. An electrical switch according to claim 7, said stiffening flanges having anchoring tabs extending therefrom, said insulating wall member having tab slots for receiving said anchoring tabs.

9. An electrical switch according to claim 8, said contact bars having terminal prongs bent tranversely therefrom, said insulating wall member having terminal prong slots for receiving said terminal prongs.

* * * * *